US005347818A

United States Patent [19]

Swartz

[11] Patent Number: 5,347,818

[45] Date of Patent: Sep. 20, 1994

[54] DEWAR WITH IMPROVED EFFICIENCY

[75] Inventor: Eric T. Swartz, Tucson, Ariz.

[73] Assignee: Research & Manufacturing Co., Inc., Tucson, Ariz.

[21] Appl. No.: 13,761

[22] Filed: Feb. 4, 1993

[51] Int. Cl.[5] ..... F25B 19/00

[52] U.S. Cl. ..... 62/51.1; 62/51.3

[58] Field of Search ..... 62/51.1, 51.3

[56] References Cited

U.S. PATENT DOCUMENTS

| | | | |
|---|---|---|---|
| 4,487,033 | 12/1984 | Sakao et al. | 62/51.1 X |
| 4,644,761 | 2/1987 | Chatzipetros et al. | 62/51.1 |
| 4,689,439 | 8/1987 | Sato | 62/51.3 X |
| 4,770,007 | 9/1988 | Murai et al. | 62/51.3 |
| 5,220,800 | 6/1993 | Müller et al. | 62/51.3 |

FOREIGN PATENT DOCUMENTS

| | | | |
|---|---|---|---|
| 2723341 | 12/1978 | Fed. Rep. of Germany | 62/51.3 |
| 437893 | 7/1974 | U.S.S.R. | 62/51.3 |
| 916921 | 3/1982 | U.S.S.R. | 62/51.3 |
| 1116265 | 9/1984 | U.S.S.R. | 62/51.3 |

OTHER PUBLICATIONS

A. Sherman & V. Figueroa, "A Portable $^3$He Cryostat for Studies in Astrophysics", Adv. in Cryo. Eng., vol. 25, Proc. of 1979 conference, Aug. 1979.

A. Demishev & N. Nazarenko, "Cryostat for Operation with an Adjustable Helium Level", Instr. and Exp. Techn., vol. 21, No. 4, pt. 2, p. 1153, Jul.-Aug. 1978.

D. Mead, "Modified Helium Cryostat for an Asymmetric Michelson Interferometer", Infrared Phy., vol. 18, No. 3, pp. 257-258, May 1978.

D. Bois & P. Pinard, "Cryostat a helium liquid pour mesures d'absoption optique", J. Phys. E., vol. 6, No. 2, pp. 120-121, Feb. 1973.

*Primary Examiner*—Henry A. Bennett
*Assistant Examiner*—Christopher Kilner
*Attorney, Agent, or Firm*—Porter, Wright, Morris & Arthur

[57] ABSTRACT

An improved Dewar including concentrically aligned neck, tail and belly sections in which the belly surrounds the tail and the tail includes a lamba plate, cooled by the flow of liquid helium from the belly, which absorbs residual heat which would otherwise reach liquid helium in the tail.

14 Claims, 2 Drawing Sheets

DEWAR WITH IMPROVED EFFICIENCY

FIELD OF THE INVENTION

This invention relates to improvements in a Dewar used for the storage of a cryogenic fluid such as helium.

BACKGROUND OF THE PRIOR ART

A conventional aluminum and fiberglass superinsulated Dewar uses several principles to provide insulation for the purpose of holding a cryogen (i.e., a cryogenic volatile liquid, usually helium) in a vessel with minimal losses. As used herein, "volatile" means a liquid which boils readily, i.e. it has a low latent heat and a normal liquid temperature below room temperature.

In a typical, conventional Dewar, the inner helium reservoir (belly, tail, and the lower part of the neck) is surrounded by vacuum. In the vacuum, which surrounds the inner helium reservoir, heat is not conducted by convection, lattice conduction, electronic conduction or other mechanisms as would occur in gases, liquids or solids. However, in the vacuum there is heat conducted by thermal (blackbody) radiation. To reduce this channel of heat transfer to the volatile cryogenic liquid, thin and reflective material is placed between the warm and cold surfaces to intercept and reflect the radiation. Even non-reflective material has an insulating effect, but reflectivity improves the insulating effect, and the more reflective (lower the emissivity), the better the insulating effect. The insulating effect also increases with the number of layers of material between the warm and cold surfaces. However, the greater the number of layers, the greater is the chance that heat will be conducted through the insulation by conventional means (via the thermal conductance through the solid which comprises the layers). Therefore, the insulating layers in the vacuum chamber of a typical Dewar are comprised of thin, low conductivity materials (aluminized mylar, typically, where the aluminum layer is very thin). The aluminized mylar layers may be separated by isolating layers of material, such as bridal veil or similarly gossamer, thin, insulating material. With any superinsulating layer design incorporating the above materials and techniques, there is an optimal packing density; techniques for maintaining this density involve slow and careful wrapping so that the correct density is achieved.

Once radiation loads of the reservoir have been substantially reduced, there remains the thermal load conducted down the neck. The neck in a typical Dewar is comprised of a material with good mechanical strength, such as a thermally insulating glass reinforced epoxy (fiberglass) or thin stainless steel. The diameter and the wall thickness of the neck tube are reduced to the minimum given other constraints of the Dewar; and the neck is made as long as mechanical, geometric, and experimental constraints allow. Some of the constraints, such as neck diameter, are determined by the use to which a Dewar is applied. Other constraints, such as the height of the Dewar—and therefore the neck length—may be determined by ceiling height. The use of the Dewar for a specific purpose of cooling an apparatus, such as a magnet or cryostat may also affect these parameters.

Even when the thermal looses from the neck and from radiation are reduced to the greatest extent possible, the conventional Dewar also uses escaping gas (which inevitably is lost due to residual loads) to intercept heat. With helium this is especially important, since the latent heat (the amount of heat necessary to boil a given quantity of liquid) is very low. The heat necessary to raise the temperature of the gas back to ambient (room) temperature (295 K., or 22° C. or 70° F.) is much greater (about 60 times) than the latent heat. Thus, the Dewar makes use of the change in enthalpy (change in heat content) of the gas by forcing gas flowing in the neck to carry away heat which would otherwise be conducted or radiated to the liquid helium in the belly and tail. The helium is directed to rise along the neck to make contact with the neck and to remove heat from the neck. Baffles thus may be included in the neck to force the flow of helium in this manner.

Another insulating technique provides cooled shields to dynamically intercept the radiation load through the superinsulation, just as the helium escaping dynamically intercepts the neck load. Thermal anchor shields may be provided at strategic locations along the neck where the escaping gas makes contact. The shields then intercept heat flow through the superinsulation and carry it to the escaping gas.

Finally, another insulating technique for a Dewar is to use a less expensive and less volatile cryogen (typically liquid nitrogen) to intercept heat before that heat reaches the more expensive, more volatile, and lower temperature cryogen (typically liquid helium). A reservoir or flow of liquid nitrogen is positioned where it can intercept heat traveling down the neck tube, and a liquid-nitrogen-cooled shield is placed in the superinsulation completely surrounding the helium reservoir to intercept residual heat flow through the superinsulation.

OBJECTS OF THE INVENTION

It is an object of the invention to provide an improvement in Dewar efficiency, reduce heat leaks, and to provide a Dewar platform of general utility which results in lower liquid consumption and reduces the cost of gas requirements.

The invention is more particularly described in the following description of the preferred embodiment which is to be read in conjunction with the drawings in which:

DESCRIPTION OF THE PREFERRED EMBODIMENT

Figure 1:
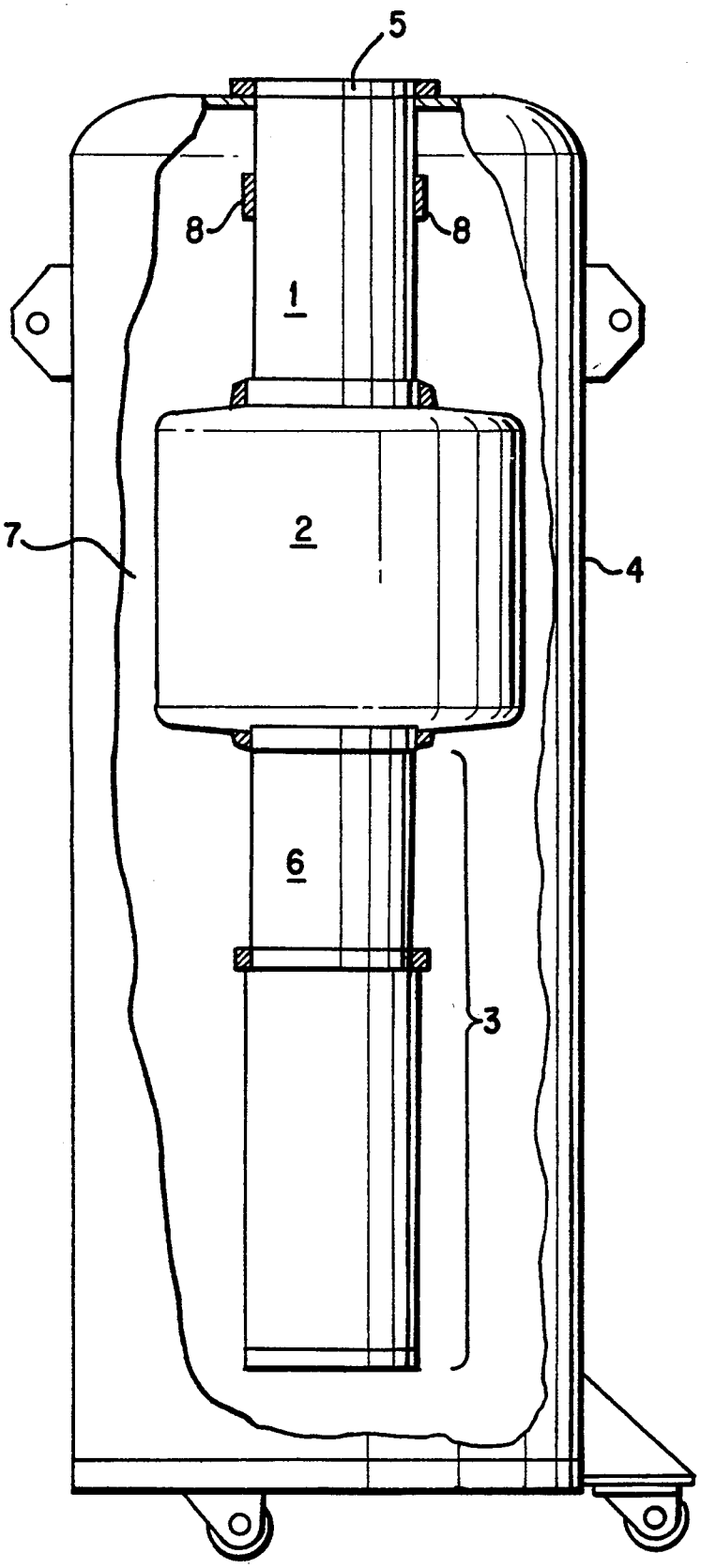
FIG. 1 PRIOR ART
FIG. 1 is a cross-sectional view of a typical prior art Dewar.

A typical prior art Dewar is shown in FIG. 1 including a neck 1, belly 2, and tail 3 enclosed in a vacuum jacket 4. The opening for the Dewar is shown at 5, and the tail section 6 adjacent the belly may be formed from a low thermal conductivity material. Multiple layers of superinsulation 7 cover all of the cold area of the interior vacuum space. Vapor cooled isothermal shields, such as are anchored on the neck and formed of a conductive material such as copper, shown at 8, are applied at four or five or more locations in the assembly.

The residual heat load on a Dewar results in a steady boil off (loss) of the cryogen. Typical values are known for given sizes and shapes of Dewars. For properly insulated and designed Dewars, the parameters which affect the boil off are the neck cross-section (usually a diameter), length and construction material of the neck, the area of the cold surface to be insulated, and the type of apparatus which is supported by the Dewar. The latter is independent of Dewar design to a good approximation, although the design of the Dewar may affect the determination of the apparatus with which the Dewar is used.

The typical Dewar geometry used for magnet experiments is the tail Dewar geometry shown in FIG. 1. The neck has an inner diameter sufficiently large to fit the magnet; the belly beneath the neck has a diameter and length sufficient to hold the quantity of helium desired; and the tail beneath the belly holds the magnet so that the magnet is always covered when there is helium in the belly.

Because the tail is below the belly, it empties after the belly empties. A typical Dewar for a 9/11 Tesla magnet may have a 30 liter belly, a 6 inch inner diameter neck and tail, a 15 inch (38 cm) long neck and a 15 inch (38 cm) deep (or deeper) tail. The tail provides a region in the Dewar which contains an amount of helium sufficient to allow Dewar operation until the helium in the belly is exhausted (or nearly exhausted), thus enhancing the overall utilization of the helium. The tail has a section with low conductivity just below the belly which allows the magnet to be cooled below the bath temperature (approximately 4.2 K.) to approximately the Lambda temperature (about 2.2 K.). The 9/11 Tesla magnet will operate at a higher field strength, 11 Tesla, when its temperature is reduced to 2.5 K. At 4.2 K. the magnet's maximum field is 9 Tesla. A longer neck is preferred, but the limitations imposed by economics and by the typical height of a laboratory ceiling may require a relatively short neck. Doubling the length of the neck would be very desirable if it could be done without increasing the total height of the Dewar. Also, decreasing the surface area which is required to be superinsulated would improve efficiency.

The invention comprises a Dewar including a vacuum enclosure for the containment of a volatile cryogenic liquid. In the Dewar, there is provided concentrically aligned neck, belly and tail sections. The tail section is a central volume extending from the neck for containing a quantity of the liquid, and the belly is an annular volume surrounding the tail which is anchored to the tail by an isothermal means at an upper section of the tail. The belly is positioned at the lower section of the Dewar (towards the bottom) and includes a level of liquid which drops below the liquid level in the tail once the Dewar begins to consume helium. At an upper section of the belly and tail, there is a means, or conduit, between the belly and tail for permitting gas flow from the belly to the tail and neck. The tail and neck comprise adjacent sections of the same extending element. The tail includes a cooling source located beneath the level of liquid contained in the tail which absorbs residual heat received by the tail. The neck, belly and tail are enclosed within the same vacuum enclosure. An annular tank comprising a volume for containing liquid nitrogen adjacent to and concentrically surrounding the neck can be provided in the upper section of the Dewar. Such a tank should be thermally anchored to an upper section of the neck and will provide additional insulation, utilizing space otherwise available in the vacuum container. Conventional insulation, superinsulation and vapor cooled shields may also be provided in the container. In addition, a getter material may be included in the container to assist in maintaining Dewar vacuum. As understood in the art, a getter is a material such as activated charcoal, zeolite or the like, which removes residual gas from the vacuum.

In the invention, the belly surrounds the tail and the tail is full at all times that there is any helium in the belly surrounding the tail. Because this is accomplished, the efficiency of the Dewar is improved. With the belly surrounding the tail, the neck is made longer without an increase in the height of the Dewar. Also, because the space within the vacuum enclosure is efficiently used, the diameter (and, therefore the cost of the Dewar) can be reduced without increasing the Dewar height. This efficient use of space also provides a convenient location for a liquid nitrogen reservoir which provides a liquid-nitrogen-cooled shield for the neck, tail and belly assembly.

Figure 2:
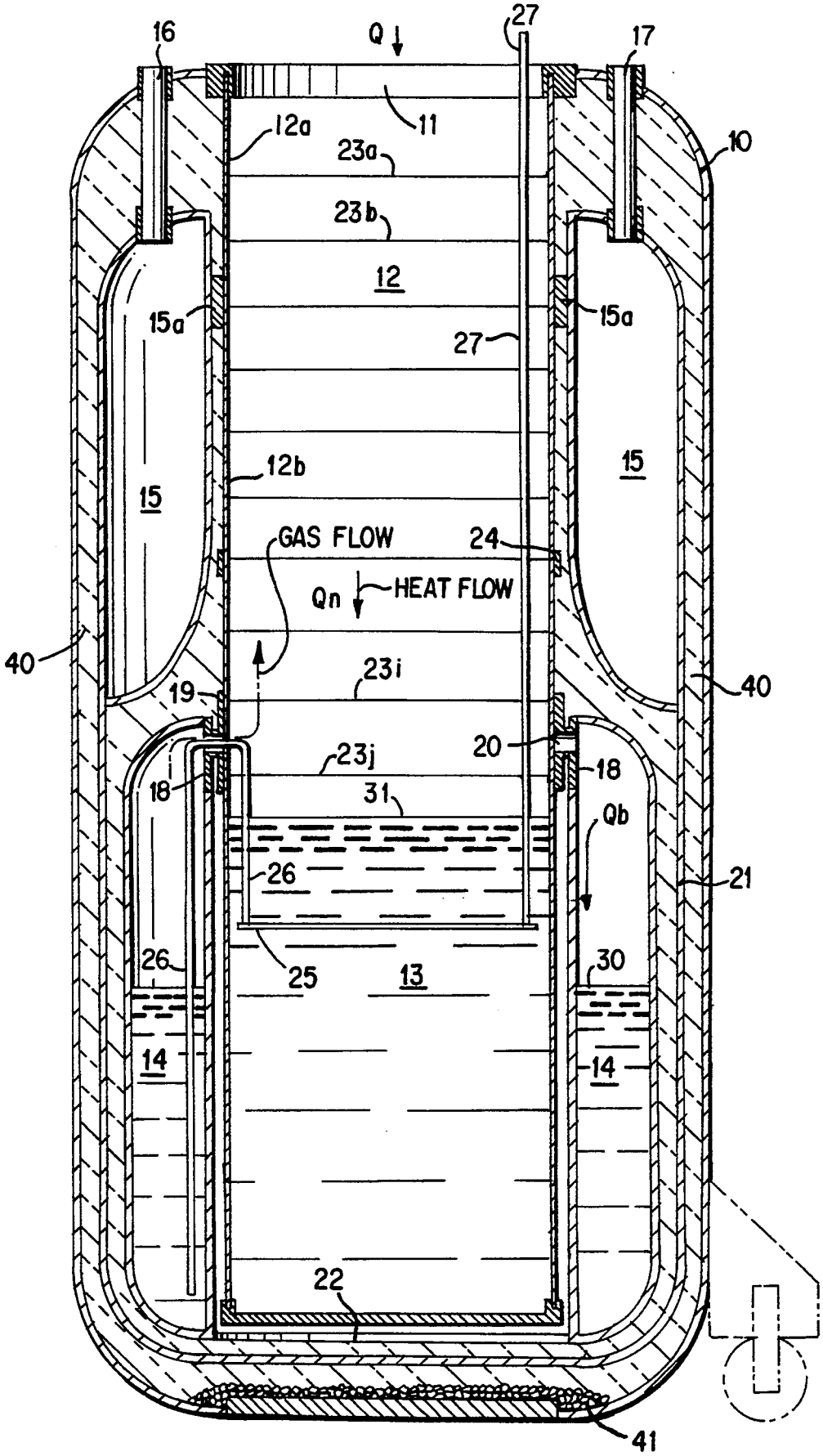
FIG. 2 is a cross-sectional representation of a Dewar configured in accordance with the invention.

The Examples below provide an analysis and a description of a helium Dewar such as shown in FIG. 2 having the improved efficiency design discussed above.

EXAMPLE 1

A representative Dewar configured in accordance with the invention is shown in FIG. 2 and includes a vacuum enclosure 10 having an opening 11 to a neck 12 leading to tail 13 which is surrounded by the belly 14. An annular liquid nitrogen tank 15 surrounds the upper portion of the neck and includes fill/vent ports 16 and 17. The mechanical support **15*a* for the nitrogen reservoir also provides a thermal anchor to intercept heat which would otherwise reach the helium in the tail. The belly 14 is anchored to the tail 13 by an isothermal anchoring means 18 which also includes via means 19 and 20 permitting the passage of gas from the belly to the tail. A liquid-nitrogen-cooled shield 21 completely surrounds the helium reservoir, and a helium cooled shield 22, cooled by the belly, surrounds the bottom of the tail. Baffles 23*a*, 23*b*, etc., are provided in the neck for controlling gas flow and for radiation shielding. The neck also may include vapor cooled shielding 24 around its periphery at various locations. The neck 12 may also be considered to have sections 12*a*, between the room temperature and the nitrogen shield, and 12*b*, between the nitrogen shield and the 4.2 K. anchor point. Superinsulation may be provided in layers or other configurations as shown at 40 and getter material 41** may also be included in the vacuum space.

The Dewar includes a lambda plate 25 having fill tube 26 from the belly and a pump tube 27 which passes through the Dewar opening to a pump. Temperature at the lambda plate is typically between 2.2 K. and 3.0 K., and in this example is 2.5 K. The typical or representative, relative levels of liquid helium in the belly and the tail are respectively shown at 30 and 31. At the level in the belly, the temperature is $4.2+E_1$; at the level in the tail, the temperature is $4.2-E_2$, where $E_1$ and $E_2$ are small temperature differences. Generally, the belly temperature is slightly greater than the tail temperature.

In the drawing, Q represents all heat traveling to the helium, regardless of where the helium is (belly or tail) or the travel path of the heat. $Q_n$ is the fraction of Q reaching the helium in a path involving the neck. $Q_b$ is the fraction of Q reaching the helium in the belly, regardless of the travel path. $Q_b$ accounts for most of Q. $Q_t$ is the fraction of Q ending up in the tail regardless of the heat path.

The Dewar of the Example is in a vacuum enclosure 24.0 inches in diameter and 53.0 inches in height. The belly is designed to contain 50 liters of liquid helium and the tail 39 liters, most of which is displaced by the magnet with which the Dewar is used. Capacity of the liquid nitrogen shield is 45 liters. Neck/tail inside diameter is 12.0 inches; and the inside diameter of the nitrogen reservoir and belly is 13.5 inches, allowing a separation from the neck/tail of approximately 0.70–0.75 inch, with allowances for material thickness. The nitrogen reservoir begins 5.75 inches from the top and terminates 25.125 inches from the top. The interior thickness of the belly chamber is 3.25 inches, less material thickness; and the belly is approximately 29.5 inches high. The belly is formed from a relatively high thermal conductivity material, such as aluminum, as are the nitrogen reservoir and the vapor cooled shields (as such elements are shown by reference numerals 14, 15, 18, 21, 22, 23, and 24). Low thermal conductivity materials, such as fiberglass, form the neck 12*a* and 12*b* and the upper portion of, or the full tail, 13. Given these volumes, materials and dimensions, other design parameters should be evident.

The drawings show the Dewar in cross-section of a circular configuration. The invention may also be adapted to other cross-sectional shapes, or other configurations, in which the same thermal principles apply.

EXAMPLE 2

With reference to FIG. 2, heat flow into the helium is Q, which is composed of radiation through the superinsulation and heat travelling through the neck channel, $Q_n$; $Q_n$ is composed of heat conduction through supports and cryostat, conduction down the Dewar neck, and radiation down the Dewar neck. Virtually all of the radiation through the superinsulation goes to the belly and, given the 2.5 inch long isothermal band 18 and isothermal (aluminum) belly, most of $Q_n$ goes preferentially to the belly. This is because the tail is isolated from and surrounded by the belly. The lowest two baffles, as shown at 23*i* and 23*j*, short most of the remaining heat $Q_n$ to the belly. In addition to isothermal radiation from the neck, shield 12 also diverts radiation to the belly. Thus, practically all of the heat received by the helium, is directed to the belly. The heat remaining which may reach the tail must be removed and this is accomplished by the use of a lambda system cooling source.

The lambda system draws helium from the belly for cooling, extracting $Q_t$. This sets up the gradient from 2.5 K. to (4.2 K.$-E_2$). The lambda plate operates by extracting a flow of helium (from the belly) through a tube 26 to a container, and vaporizing this helium in the container. The flow is controlled usually with a flow impedance, which may be a fixed impedance, a variable impedance, or a metering valve. Pumping lowers the pressure over the liquid in the lambda plate which causes helium to vaporize as it attempts to maintain equilibrium. As this helium vaporizes, it absorbs heat. This causes the temperature of the helium in the container to drop, and therefore the temperature of the helium in the tail drops. The requirement for the invention is that the residual heat flowing to the tail be absorbed by the lambda plate. For most applications, an additional requirement is that the temperature of the lambda plate be lower than that of the helium in the belly. For a given temperature difference, a heat flow is established from the relatively hotter belly to the colder tail. The magnitude of the heat flow depends on the temperature difference as well as the thermal conduction between the hot and cold parts. By using low conductivity materials, the heat flow can be reduced to the point that the lambda plate can cool the lower part of the tail to about 2.2 K. as it extracts the residual heat flowing to the tail.

All of the heat $Q_t$ traveling down to the tail is conducted to the lambda plate (no heat remains to vaporize helium in the tail)—therefore liquid in the tail does not boil. In other words, because the temperature at the surface of the liquid in the tail is below that temperature corresponding to the pressure over the surface (using the saturated vapor pressure curve for helium), slightly more helium will condense than boil. The smaller $E_2$ is, the closer is the equality or equilibrium of the condensation and the vaporization of helium. All of the vaporization originates in the belly. Thus, the lambda system cooling source, for which belly helium is used, extracts residual heat conducted to the tail. The amount of residual heat is small because the belly shields virtually all of the heat input.

In the system, all or part of the liquid helium in the belly is below the level required in the tail. The lambda plate cooling source is used to maintain a liquid level in the tail. As a result, the invention provides a more efficient use of volume and lengths. The longer neck implies lower loss and better shielding efficiency in that there is a greater length over which the exhaust gas can make contact. More efficient magnet leads are possible (Again, there is a greater length over which the exhaust can make contact). And, the area of 4.2 K. which must be superinsulated is reduced, again, lowering gas loss and reducing operating cost.

Physically positioning all or part of the belly below the liquid level required by the tail provides room for an optional nitrogen reservoir. Hence, the overall length and diameter of the Dewar can be simultaneously reduced.

Because magnet systems often have a lambda plate, the requirement of the invention that a cooling source maintain a cooled section in the tail is not a disadvantage for such systems. The helium in the lambda pump tube which comes from the belly, not the tail, can also be used to cool shields, for example, for magnet leads or other apparatus.

EXAMPLE 3

In comparison with the Dewar of Examples 1 and 2, a conventional Dewar with the same height would be approximately 28 inches in diameter, or larger. In such a conventional Dewar, the inclusion of a nitrogen shield would be problematic, the neck would be short, the Dewar efficiency would not be great, and the superinsulation requirements would be greater. With the invention, the nitrogen reservoir can be added without increasing the diameter of the Dewar. Fiberglass, or some other low conductivity material, need be used in the tail only down to where the gradient stops, at the lambda plate.

Thus, the invention is an improved Dewar in which neck, belly and tail sections are concentrically aligned and in which the tail and neck comprise adjacent sections of the same extending element. The tail is positioned centrally within the sections and contains a quantity of the cryogenic liquid. The belly contains a quantity of the liquid, and surrounds and is thermally anchored to the tail by an isothermal means at an upper section of the belly in communication with an upper section of the tail. The upper section of the belly has means between the belly and tail for permitting gas flow from the belly to the tail to the neck.

In the invention, the tail also includes a cooling source at a location in the tail which is beneath the level of liquid to be contained in the tail, for absorbing the residual heat, $Q_t$, conducted from the ambient environment of the Dewar to the tail. This cooling source is a lambda plate which is typically an extended and flattened hollow member having a pathway for the flow of liquid helium therethrough. The plate is cooled by the pumped flow of liquid helium from the belly through the plate pathway.

The neck extending from the tail includes a terminal section open to the ambient environment of the location of the Dewar. An annular tank for containing a quantity of liquid nitrogen may concentrically surround the neck and be thermally anchored to an upper section of the neck. And, the annular tank containing liquid nitrogen may also be thermally connected to a thermal shield which operatively surrounds the sides and bottom of the tail and belly sections.

The belly may also include a thermally conductive bottom plate spaced apart from the bottom of the tail the plate forms a thermal shield for the bottom section of the tail. In this manner efficient shielding and insulation of the liquid helium is effected. A segment of the upper section of the belly may also be anchored by a concentric thermally conductive member to the upper section of the tail to form an isothermal anchor between the upper section of the tail and belly. The means for the passage of gas from the belly to the tail is through an opening in the isothermal anchor.

Vapor cooled thermal shields within the neck, isothermal shields concentrically surrounding the neck, and superinsulation may also be utilized in the configuration of the invention. The superinsulation may be interposed between the interior surface of the outside wall of the Dewar and at least one of the neck, tail and belly sections or between the interior surface of the outside wall of the Dewar and the thermal shield extending from the annular tank. The interior volume of the Dewar may also include a getter material which is thermally anchored to the belly or tail.

Thus a basic configuation is provided which can be adopted to various shapes and sizes, not merely the circular/concentric arrangement which is described as the preferred embodiment.

Estimates for a operating condition of conventional Dewar of the same height as the Dewar of Examples 1 and 2 result in losses of greater than 15 liters of liquid helium per day. With the invention, using the nitrogen reservoir, losses would be under 5 liters per day, a savings of 10 liters per day and a factor of 3 improvement. Additional helium savings also accumulate because, with the longer neck, the other heat inputs caused by, for example, magnet leads, can be better optimized. Longer sections of the apparatus inserted into the Dewar over which the gradient between 4.2 K. and room temperature (approximately 300 K.) is allowed also decrease helium operating costs.

The invention thus provides an efficient "platform" onto which one can design an efficient system for most predetermined applications without significantly affecting manufacturing costs.

What is claimed is:

1. In a Dewar for the containment of a volatile cryogenic liquid, the improvement, within the vacuum enclosure of the Dewar, comprising:

neck, belly and tail sections in which the tail and neck comprise adjacent sections of the same extending element;

the tail being an extended volume for containing a quantity of the liquid located centrally within the sections;

the belly comprising an annular volume capable of containing a quantity of the liquid, said belly surrounding the tail and being thermally anchored to the tail by an isothermal means at an upper section of the belly in communication with an upper section of the tail, the belly further having at the upper section thereof means between the belly and tail for permitting gas flow from the belly to the tail to the neck, the tail further including a cooling source at a location in the tail which is beneath the level of liquid to be contained in the tail, said cooling source comprising means for absorbing the residual heat, $Q_t$, conducted or radiated from the ambient environment of the Dewar to the tail;

the neck section of the extending element including a terminal section open to the ambient environment of the location of the Dewar.

2. The Dewar of claim 1 having an annular tank for containing a quantity of liquid nitrogen adjacent to and concentrically surrounding the neck, said nitrogen tank being thermally anchored to an upper section of the neck.

3. The Dewar of claim 1 in which the cooling source located in the tail is a lambda plate.

4. A Dewar containing a volatile cryogenic liquid including:

a vacuum enclosure;

neck, belly and tail sections included within the enclosure, the neck and tail being longitudinally connected, the tail containing a quantity of the cryogenic liquid, and the belly being an annular volume which surrounds the tail and contains a quantity of the cryogenic liquid;

means between the belly and tail for permitting the flow of gas which evaporates from the liquid in the belly, from the belly to the tail and through the neck;

the tail further including a cooling source located beneath the level of cryogenic liquid in the tail, said cooling source comprising means for absorbing the residual heat, $Q_t$, from the ambient environment of the Dewar, which is conducted or radiated to the tail; and an annular tank containing liquid nitrogen surrounding the neck at an upper section thereof, the neck having an opening to the ambient environment of the location of the Dewar.

5. The Dewar of claim 4 in which the annular tank containing liquid nitrogen is thermally connected to a thermal shield which surrounds the sides and bottom of the tail and belly sections.

6. The Dewar of claim 1 or claim 4 in which the belly includes a thermally conductive bottom plate spaced apart from the bottom of the tail, which plate forms a thermal shield for the bottom section of the tail.

7. The Dewar of claim 1 or claim 4 including at least one vapor cooled thermal shield within the neck.

8. The Dewar of claim 1 or claim 4 including at least one isothermal shield concentrically surrounding the neck.

9. The Dewar of claim 1 or claim 4 including superinsulation interposed between the interior surface of the outside wall of the Dewar and at least one of the neck, tail and belly sections.

10. The Dewar of claim 5 including superinsulation interposed between the interior surface of the outside wall of the Dewar and the thermal shield extending from the annular tank.

11. The Dewar of claim 1 or claim 4 in which a segment of the upper section of the belly is anchored by a concentric thermally conductive member to the upper section of the tail, forming an isothermal anchor between the upper section of the tail and belly, and in which the means for the passage of gas from the belly to the tail includes an opening through said isothermal anchor.

12. The Dewar of claim 1 or claim 4 in which the lambda plate is an extended hollow plate member having a pathway for the flow of liquid helium therethrough and is cooled by the pumped flow of liquid helium from the belly through said pathway.

13. The Dewar of claim 1 or claim 4 in which the interior volume of the Dewar includes a getter material.

14. The Dewar of claim 1 or claim 4 in which the neck, belly and tail section are concentrically aligned.

* * * * *